United States Patent [19]

Wiggins

[11] 3,981,320

[45] Sept. 21, 1976

[54] RECOVERY SYSTEM FOR SPRAY PAINTING INSTALLATION WITH AUTOMATIC COLOR CHANGE

[75] Inventor: Richard F. Wiggins, Fairfield, Conn.

[73] Assignee: The Gyromat Corporation, Stratford, Conn.

[22] Filed: Apr. 9, 1975

[21] Appl. No.: 566,290

Related U.S. Application Data

[62] Division of Ser. No. 468,973, May 10, 1974, Pat. No. 3,939,855.

[52] U.S. Cl. ..... 137/240; 239/3; 239/69; 239/124

[51] Int. Cl.[2] ..... B05B 5/02; B05B 7/26

[58] Field of Search ..... 137/240, 624.18; 239/3, 239/69, 124

[56] References Cited

UNITED STATES PATENTS 3,458,133 7/1969 Wiggins ..... 137/240 X

*Primary Examiner*—Alan Cohan

*Attorney, Agent, or Firm*—Mandeville and Schweitzer

[57] ABSTRACT

The disclosure relates to automatic paint spray systems, typically but not necessarily of the electrostatic type, provided with color change means and facilities for recovery and re-use of the residual paint increment contained in the system at the start of a color change cycle. The system of the invention provides for an automatic color change cycle in a paint spray system, in which original paint is purged from the system by terminating the supply of the original paint and introducing purge fluids, including solvent and possibly also air. Principally, the original paint is purged through a discharge line, on the downstream side of the paint spray devices, and is collected in a suitable receptacle, along with the purged solvent. A unique feature of the new system resides in the ability of the discharge system to automatically separate and isolate the original paint from the new color paint, so that the purged paint may be collected in a segregated container and re-used.

In a high volume appliance production operation, for example, it may be necessary or desirable to execute a color change cycle dozens of times in a typical production day, so that significant savings can be realized by enabling segregated collection and ultimate re-use of the purged materials. In a typical commercial installation, savings in excess of $20,000 per year are to be anticipated. Perhaps more importantly, the savings of materials is of great significance because of the limited availability from time to time of some paints and solvents, regardless of cost.

13 Claims, 5 Drawing Figures

RECOVERY SYSTEM FOR SPRAY PAINTING INSTALLATION WITH AUTOMATIC COLOR CHANGE

This is a division of application Ser. No. 468,973, now U.S. Pat. No. 3,939,855, filed May 10, 1974.

BACKGROUND AND SUMMARY OF THE INVENTION

The present invention relates to paint spray systems, most typically but not necessarily of the electrostatic type. More particularly, the invention relates to a new and improved system for effecting a color change cycle in an industrial paint spray system, in a manner permitting segregation and separate collection of the residual paint remaining in the system at the commencement of a color change cycle.

In the R. F. Wiggins U.S. Pat. No. 3,348,774, owned by the assignee of the present invention, an advantageous arrangement is shown for effecting a color change cycle in an industrial painting system. This arrangement includes an in-line valve manifold containing a series of paint color valves, as well as purge valve means for solvent and air. When it is desired to change over the system from one paint color to another, a cycle control is initiated to sequentially terminate the supply of original paint, flush out the system with solvent, and possibly also with air, and introduce paint of a new color into the system. To avoid having to discharge a substantial volume of paint and solvent into the spray booth area, discharge conduits are provided, communicated with the spray devices only substantially at the spray nozzle, immediately upstream of the discharge valves for the nozzles. When a color change cycle is initiated, the spray nozzle valves are closed and so-called "dump" valve means in the discharge lines are opened, enabling the original paint and the cleaning solvent to be discharged from the dump valve and into a suitable receptacle. The new paint flows through the system until it commences to flow into the discharge line, on the downstream side of each spray gun, after which the dump valve means can be closed and the spray nozzles re-opened.

In prior color change systems, there has been no convenient facility for easily segregating and separately collecting the unused paint of an original color, as it is purged from the system in preparation for a new color. While, of course, it has been theoretically possible to accomplish this, the practical economics of performing an effective segregation with existing equipment has not been favorable.

As a feature of the present invention, a novel, yet highly simplified arrangement is provided which enables successive colors to be readily isolated from each other, and effectively and separately collected, all as a part of a substantially automatic cycle requiring a relative minimum amount of time and operator attention. In part, this is achieved by providing a pair of spaced trap valves, with an "inventory line" of substantial length connected therebetween and desirably formed of transparent or translucent material. During the course of a color change cycle, it is readily possible to time with the cycle timer the purging of the existing paint through the inventory line, and the subsequent entry into the inventory line of the new color paint. When the new color has entered the inventory line, the timer then closes both trap valves. This provides for an uninterrupted column of paint upstream of the inventory line and complete segregation of the original paint downstream of the inventory line. Upon closing of the trap valves, the painting system may be reactivated to apply the new color at the spray station. Independently, additional purging solvents and fluids may be introduced downstream of the inventory line to effect thorough clean out of the discharge line in preparation for a subsequent color change cycle.

To advantage, the system of the invention permits all of the paint recirculation and supply functions to be confined substantially within a segregated paint mix room or area although such is not required by the invention. Moreover, the discharge section of this system may terminate remotely, within the paint mix room, so that all paint mixing and handling functions can be accomplished entirely remote from the spray area.

In cases where a relatively elaborate system is desired, the segregation and separate collection of paints, during a color change cycle, may be sequenced in such manner that the purged material is discharged back into a segregated auxiliary paint supply associated with the vessel from which the paint was supplied in the first instance. In a more economical system, suitable for many applications, purged paint is segregated into separate vessels and remixed at a subsequent convenient time.

In those instances where the purged materials are to be returned a substantial distance to a remotely located mixing room, the trap valves and inventory line are, according to the invention, located in reasonably close proximity to the spray booth area. This maintains at a minimum the volume of new paint required to properly charge the system in preparation for painting of a new color, and thus tends to minimize the increments of paint required to be purged when a color change cycle is effected.

The system of the invention is readily adaptable to effecting sequential color change cycles in a series of paint stations. Thus, the system is ideally suited for typical industrial paint spray installations, in which a plurality of paint spray stations are located at spaced positions along a conveyor route.

For a better understanding of the above and other features and advantages of the invention, reference should be made to the following detailed description, and to the accompanying drawings.

DESCRIPTION OF PREFERRED EMBODIMENTS OF THE INVENTION

Figure 1:
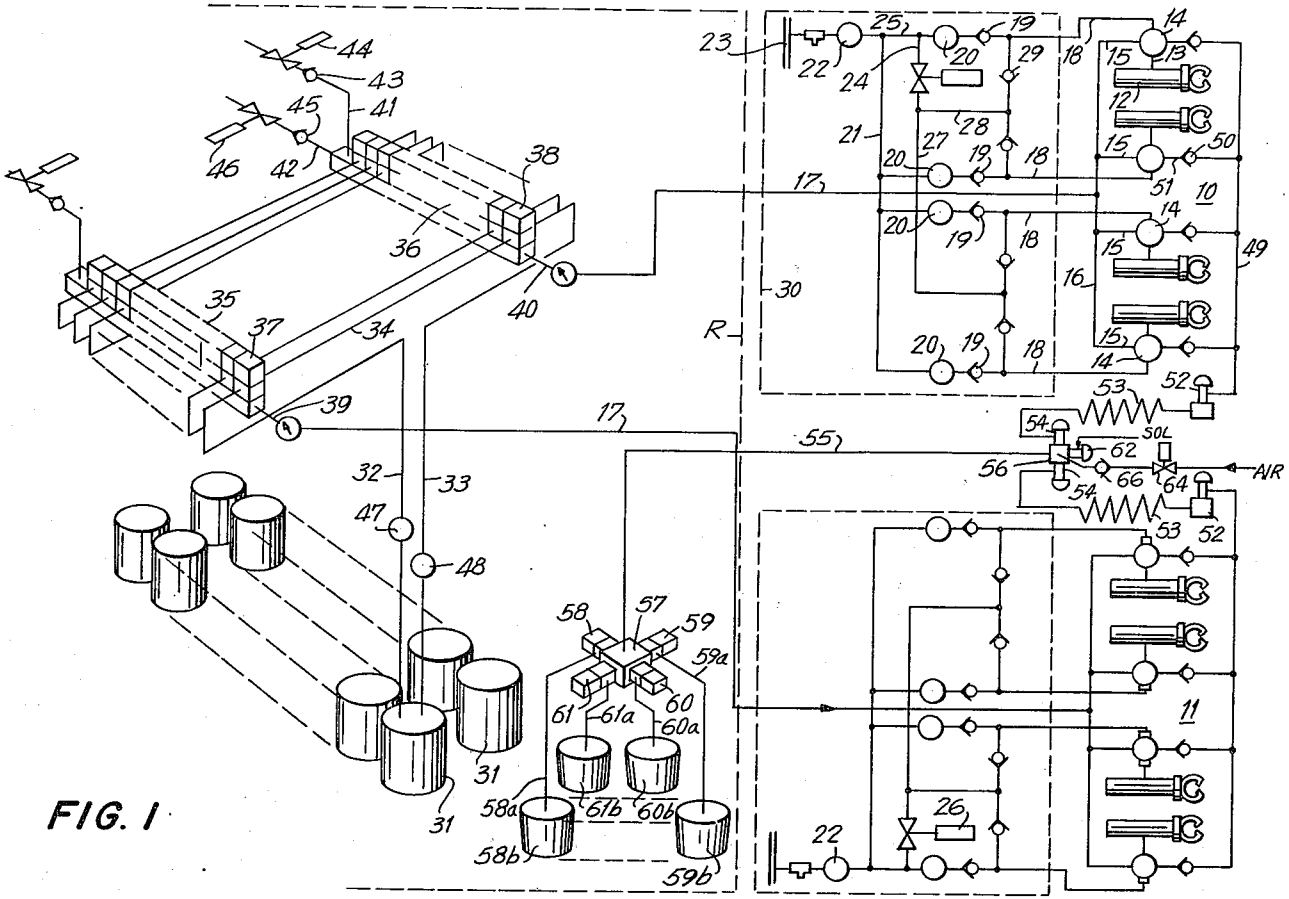
FIG. 1 is a highly simplified, schematic representation of a typical industrial paint spray installation incorporating a color change system according to the present invention.
Figure 2:
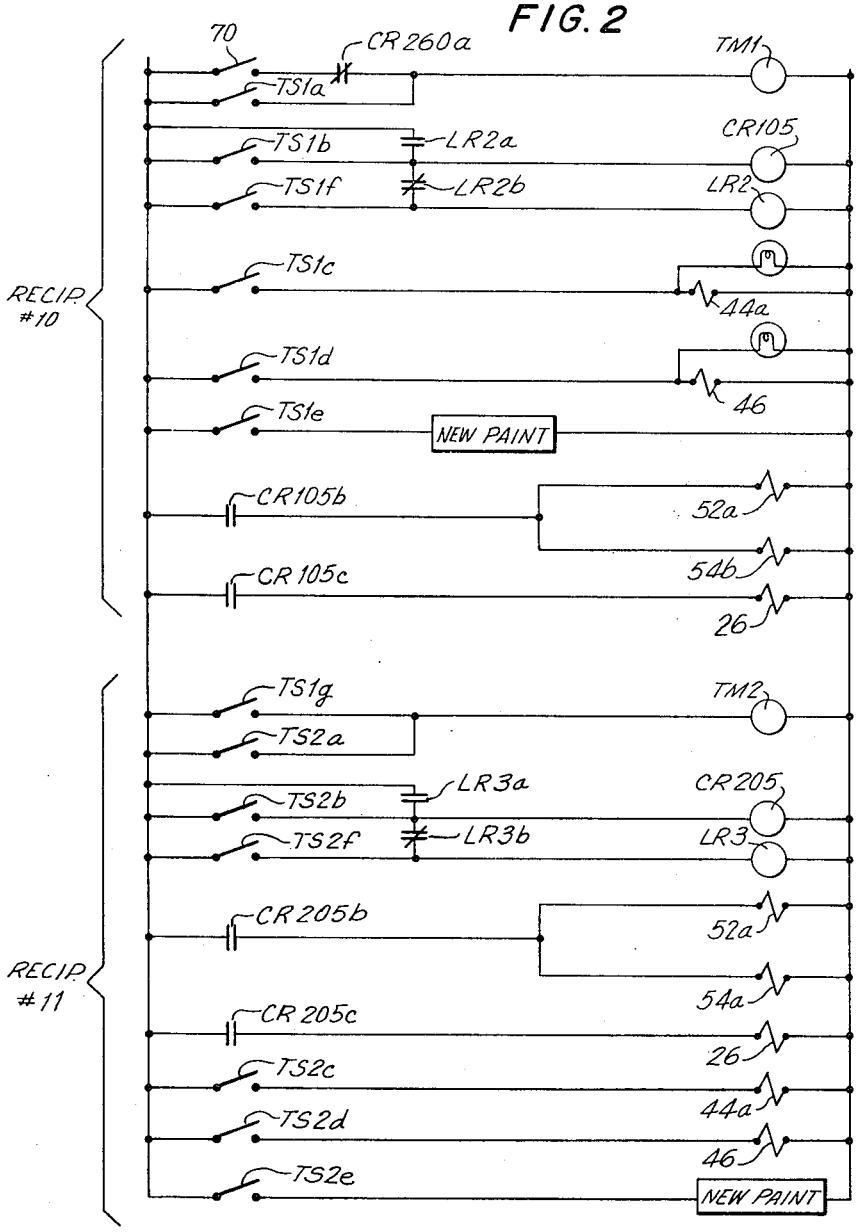
FIGS. 2 and 3 are simplified, schematic representations of a control circuit arrangement, suitable for use in connection with the system of FIG. 1.

Referring now to the drawings, and initially to FIGS. 1 and 2 thereof, the reference numerals 10, 11 designate generally a pair of reciprocator stations of a typical industrial spray painting installation. As will be readily understood by those skilled in the art, the reciprocator stations 10, 11 may be placed in side-by-side relation, adjacent the path of a suitable conveyer system (not shown) arranged to carry workpieces past the reciprocator stations in sucession. By way of example only, the first reciprocator station 10 may apply paint to one side of a large panel or cabinet, while the second station 11 coats another side. As many stations in succession may be utilized as needed to adequately coat the part with one or more layers of the coating material. In general, the principles of the invention are applicable to systems utilizing one or more reciprocator stations.

Although the number and type of spray devices utilized in the reciprocator stations is not material, a typical and desirable reciprocator installation may utilize a series of several vertically stacked spray guns 12, each reciprocator in the illustrated arrangement having four such spray guns. A particularly desirable form of such spray gun is the model LCV P2 low velocity electrostatic spray gun marketed by the Gyromat Corporation of Stratford, Connecticut. In the illustrated system, each of the reciprocator installations is of similar construction, and similar reference numerals will be applied wherever the context admits thereof.

In the illustrated system, each of the spray guns 12 is connected by a short conduit 13 to the downstream or regulated side of a paint or fluid pressure regulator 14. The inlet side of the fluid regulator is connected through a line 15 to a header line 16, and this in turn is connected to a supply line 17 leading from a fluid selection system to be described. Thus, fluid supplied through the line 17 is delivered to the various spray guns 12 at controlled, regulated pressure determined by the several fluid regulating devices 14.

In accordance with the teachings of the E. O. Norris U.S. Pat. No. 3,219,276, the fluid regulators 14 are physically arranged for vertical reciprocation with the spray guns 12, to provide for adjustably controlled fluid pressure at the discharge of the spray guns, regardless of the vertical movements of the spray devices relative to a stationary supply of paint or other coating material. Control of the regulated pressure on the downstream side of the fluid regulator 14 is, in accordance with the E. O. Norris U.S. Pat. No. 3,219,276, effected by controlling air pressure applied to the upper portion of a fluid regulator diaphragm. The control air pressure is supplied through a flexible insulating conduit section 18 connected through a check valve 19 to a manually adjustable air pressure regulator 20. It will be noted, in this respect, that the fluid regulator 14 for each spray device is provided with a separate, independently adjustable air pressure regulator 20, so that the several spray devices may be individually adjusted. The upstream or high pressure side of each of the air pressure regulators 20 is connected through a header line 21 to an additional pressure regulator 22, and the upstream side of the last mentioned regulator may be connected to the plant air source designated by the reference numeral 23.

For normal pressure control operations, the plant air pressure in regulated at 22 to some intermediate pressure level, which is applied to the high pressure side of the several independently adjustable control regulators 20. For purposes to be described, it is desirable at times to bypass the control regulators 20 to cause a higher regulated pressure to be delivered to the spray devices 12. To this end, an intermediate pressure line 24 is teed off of the line 25, containing air at the intermediate control pressure from the pressure regulator 22. A solenoid actuated control valve 26 is connected in the line 24 and serves to close it off during normal operations. When it is desired to apply the intermediate pressure level at the fluid regulator devices 14, the solenoid valve 26 is actuated to its open condition, admitting fluid at intermediate levels into lines 27, 28. This fluid passes through the several check valves 29, in bypassing relation to the low pressure regulators 20 and their associated check valve 19, causing the intermediate pressure to enter the lines 18 and be applied to the several fluid pressure regulators 14. Upon subsequent deenergizing and closing of the solenoid valve, the intermediate pressure within the lines 18 will be dissipated through appropriate bleed openings, and the controlled pressure will drop back to that determined by the respective low pressure regulator 20 for each spray device. As will be appreciated, the several low pressure regulators 20, the intermediate pressure regulator 22, the solenoid valve 26, the several check valves 19, 29, and related components may be housed remotely of the spray devices 12 in a suitable control cabinet 30.

In the system of the invention, the supplies of paint or other coating material, typically may be housed remotely of the reciprocator station in an isolated paint room R. To this end, there may be provided a series of paint drums or other containers 31, each containing a coating material of specific color or other characteristic. To simplify the description, fluid connections are illustrated only to one container 31. These include an outlet line 32 and a return line 33. The outlet line 32 communicates with a recirculating loop 34, which connects with color selection manifold valve assemblies 35, 36, there being one such color selection manifold for each of the reciprocator stations 10, 11. By means of an appropriate pumping system, coating material enters the outlet line 32 flows through the recirculating loop 34, through the appropriate individual color selection valves 37, 38 associated with the color selection manifolds, and then flows through the return line 33 to the container drum. As coating material is called for by the reciprocator stations, it is permitted to flow through the outlet conduits 39, 40 of the color selection manifolds and into the supply conduits 17.

To advantage, the color selection system reflected in FIG. 1 may incorporate features of the R. F. Wiggins U.S. Pat. No. 3,348,774. Such a system includes one or more of the color selection manifolds 35, 36 located remotely of the reciprocator stations, with each of a plurality of independently controlled paint selection valves being associated with a separate supply container for a designated paint color. At the upstream end of each of the color selection manifolds, there are provided solvent and air inlet lines 41, 42. The solvent line 41 is connected through a check valve 43 and solenoid valve 44 to a suitable source (not shown) of solvent under pressure. In a similar manner, the air line 42 is connected through a check valve 45 and solenoid valve 46 to a suitable source of compressed air.

In a typical painting operation, paint from each of the several containers 31 is continuously circulated in the lines 32–34, being maintained under a suitable pressure higher than that desired at the spray devices 12. Any suitable means, such as a pump 47 in the outlet line and the back pressure valve 48 in the return line may be utilized for maintaining a desired pressure in the recirculating loop 34.

During the course of a painting operation, a selected pair of valves, connected to the recirculating loop 34 of a desired color, will be opened, admitting fluid of that color into the manifold outlets, 39, 40 and into the supply conduits 17. This fluid is discharged by the spray devices 12 in the manner before described. To effect change of paint color in the system, a cycle of color change operations is initiated, in which the original paint is purged from the system, and then a new paint is introduced.

In accordance with the teachings of the before mentioned R. F. Wiggins U.S. Pat. No. 3,348,774, a discharge or purge system is connected to the paint delivery system for each of the spray devices 12, substantially at the spray devices themselves, as close to the spray discharge outlet as is reasonably practicable. In the illustrated system, a purge line header 49 is connected through individual check valves 50 and individual purge lines 51 to the various spray devices 12, at or downstream of the regulated side of the fluid regulators 14. The purge header line 49 is connected through a first trap valve 52, an elongated inventory line 53, and a second trap valve 54 to a purge outlet line 55. In the system of FIG. 1, each of the reciprocator stations 10, 11 is provided with a separate purge system including trap valves 52, 54 and elongated inventory lines 53, feeding a common purge outlet line 55. Desirably, the second or downstream trap valves 54 are part of a purge manifold 56, the common cavity of which is connected to the purge outlet line 55. Desirably, the purge manifold is located near the reciprocator stations, while the purge outlet line 55 may lead back to an isolated paint mixing room R, where the line terminates in a discharge manifold assembly 57. In the system illustrated in FIG. 1, the discharge manifold 57 has a plurality of selectively actuated discharge control valves 58–61 connected to the common cavity manifold 57 and operative selectively to permit discharge of purged material into any one of discharge lines **58*a*–61*a*.**

In the system of FIG. 1, the discharge lines lead to a limited number of collection vessels **58*a*–61*a*. In a more comprehensive system, reflected in FIG. 3 to be described, a discharge manifold may be provided with as many valves as there are paint containers, and the discharge material may be flowed directly through the discharge lines to auxiliary mixing vessels associated with the individual supply containers or, in some cases, back to the original containers themselves. The system of FIG. 1,** is, of course, of lower initial cost and may be more appropriate for many applications, as where color change cycles are not executed with unusually high frequency.

To advantage, the inventory lines 53 are located relatively near the reciprocators. These inventory lines are of relatively small diameter (e.g. ¼ inch – ⅜ inch inside diameter), of relative substantial length (e.g. 10 to 15 feet), and typically they are formed of transparent or translucent material. Typically, although not necessarily, the inventory lines are in a coiled configuration, so that the entire length of a line occupies a relatively small area which may be easily observed.

At the commencement of a color change operation, the reciprocator spray devices are closed, as are the original paint selection valves back at the color selection manifolds. The trap valves 52, 54 are opened, and a selected one of the discharge manifold selection valves 58–61 is opened. The solvent valve 46, at the upstream end of the color selection manifold, is opened, permitting solvent to enter and flow through the color selection manifold, through the supply conduit 17, and into and through the fluid regulators 14 associated with each spray device. With the spray devices being closed, and the various valves of the purge system being opened, the original paint is pushed out through the purge system by the advancing solvent. The solvent flow cleanses the supply system leading to the reciprocator, including the regulators 14, of the original paint. In addition, at some point after the regulators 14 are filled with solvent, the spray devices 14 are opened momentarily to effect a spray-out of the small residual (usually 1–2 cc) of paint, which is otherwise bypassed by the purging system.

Typically, after the solvent flow has continued for an appropriate interval, the solvent valve 46 can be closed and the air valve 44 opened. The air thus admitted in the upstream end of the color selection manifold drives ahead of it the solvent, and also the original paint which is in front of the solvent, and all of this material is driven out of the purge system and into the selected containers **58*a*–61*b*. The air purge operation, while not necessary for clean out purposes, is desirable, particularly where the supply line 17** may be of substantial length, to reduce the overall quantities of solvent required to purge the system.

After cleansing of the original paint from the system and with the air and solvent valves 44, 46 closed, a new color selection valve is opened, admitting paint of a new color into the color selection manifold 36 and its associated supply conduit 17. The new color paint flows through the sytem pushing ahead of it the purging air from the preceding stage of the color change cycle. In due course, the new paint enters and fills the regulators 14 and then flows into the purge header line 49 and begins to flow through toward the purge outlet line 55.

In accordance with a significant feature of the invention, it is not required, in the primary color change cycle, to cleanse and refill the system on the downstream side of the spray guns, all the way back to the paint mix room, which may be located a substantial distance from the reciprocators. It is only necessary to cleanse the system up to the purge manifold 56, at the upstream end of the purge outlet line 55. And desirably, the purge manifold may be located as close as reasonably practicable to the reciprocators. Once the purged fluids have advanced to a point downstream of the purge manifold, no further purging is required to be done through the spray guns themselves. Instead, in accordance with the invention, a secondary purge system is provided, to be described in more detail, which purges the system from the purge manifold on downstream through the discharge manifold 57.

As shown in FIG. 1, the purge manifold 56 includes a fluid valve 62, connecting a secondary solvent line 63 to the manifold, and a solenoid valve 64 connecting a secondary air line 65 to the purge manifold, through a check valve 66. Thus, after completion of a color change cycle at both of the reciprocator stations 10, 11, the reciprocators can be isolated from the secondary purge system by closing off the trap valve 54, and a secondary purge operation may be carried out by sequentially opening the solvent valve 62, followed by the air valve 64. The residual materials in the purge outlet line 55, leading all the way back to the paint mix room, thus can be purged independently of the reciprocators 10, 11, and even after those reciprocators have been returned to production operations, coating the new color paint.

Even with the secondary purge system, it is important to isolate the new color paint from the purge outlet line 55, in order to be able to segregate and re-use the residual materials in the purge outlet line. To this end, it is necessary to block off the incoming flow of new paint before it reaches the downstream trap valve 54. This is accomplished, in accordance with the invention, by providing the elongated inventory lines 53, connected between the pairs of trap valves 52, 54. As the color change cycle for a reciprocator nears completion, an appropriate timing device, after allowing for the advancing new color paint to enter the inventory line, terminates the color change cycle. This operation includes closure of the trap valves 52, 54.

As will be readily appreciated, of course, termination of the color change cycle could be accomplished by manual means, if desired. The significant consideration is that the advancing "front" of the new paint be reliably isolated and trapped between the valves 52, 54. In this respect, the provision of the upstream valve 52 is regarded as having significance in providing a solid column of paint between the valve and the spray discharge devices 12. Particularly, where an air purge spray is utilized, there will be a quantity of air under pressure trapped between the "front" of the new paint and the closed isolating valve 54. This creates a danger that some of this air will, during the course of paint spray operations, migrate to the spray discharge devices, causing sputtering at the discharge and resulting in defective production. By providing the upstream isolating valve 52, which will close with a solid column of paint upstream from it, migration of air to the discharge devices is precluded.

Figure 3:
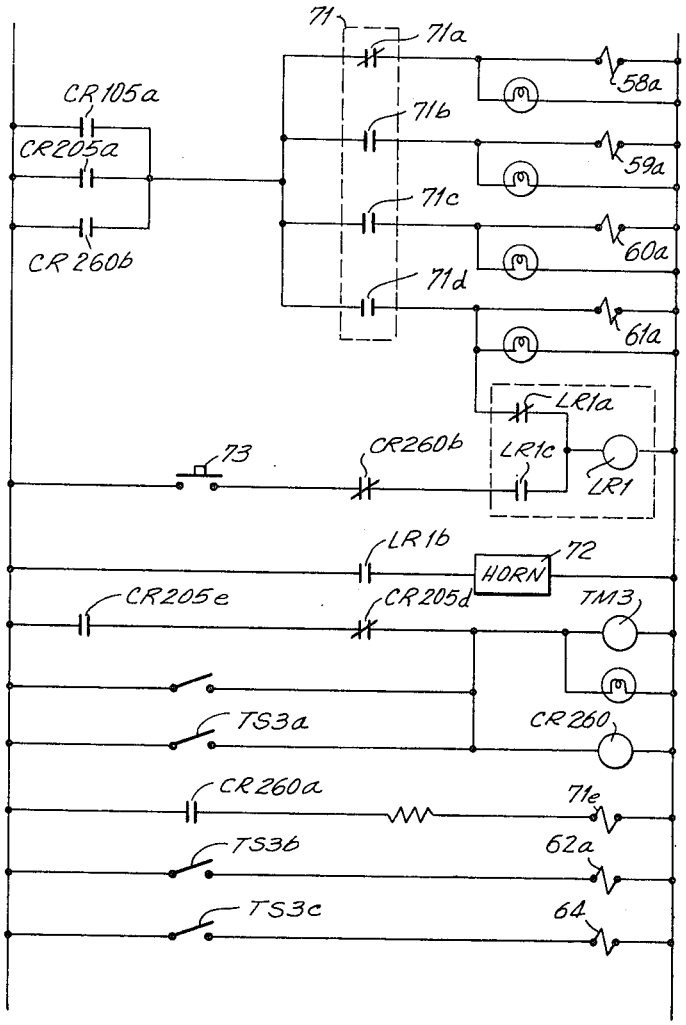

Referring now to FIGS. 2 and 3, there is shown, in a highly simplified representation, a circuit arrangement for effecting a color change cycle in accordance with principles heretofore outlined. A manual or other switch 70 is closed to energize, through normally closed contacts CR260*a* of a relay CR260, a timing motor TM1, and this commences the color change cycle for the first reciprocator 10. The timing motor is a one revolution device which actuates a number of timing switches in sequence, to carry out the desired color change functions.

Immediately upon energizing of the timing motor TM1, a switch TS1a is closed. This switch is in parallel with the switch 70 and contacts CR260*a*, and serves to keep the timing motor energized throughout a single cycle of operation.

Early in the color change cycle, timing switch TS1*b* closes, energizing a relay CR105. Among other things, contacts CR105*a* (FIG. 3) are closed, completing a circuit through a closed contact of cycling step switch 71, energizing one of a selected plurality of solenoid valves 58*a*–61*a* controlling air-operated discharge control valves 58–61 associated with the discharge manifold 57. In this respect, any of the fluid valves located in the painting area are generally precluded by regulation from being electrically operated, so solenoid-operated pilot valves are remotely located and function to control air under pressure for opening and closing the fluid valves themselves. See U.S. Pat. No. 3,572,366 for example of such valves.

In the illustrated arrangement, the switch 71*a* is closed, such that the discharge valve 58 will be energized and opened upon closing of contacts CR105*a*.

The switch 71 may be a conventional step switch, which is advanced sequentially with each color change cycle, so that the contacts 71*a*–71*d* are closed one at a time and in sequence. Thus, with successive color change cycles, the purged materials are discharged into separate collection receptacles 58*b*–61*b*.

When the last of the series of the discharge valves has been energized, a latch relay LR1 is energized through the contact 71*d* and the normally closed latch relay contact LR1*a*. This results in the energizing of a horn or other signal 72, through normally open contacts LR1*b*, assuring that the operator is aware of the fact that the last of the series of receptacles has been utilized. The signal will continue to be energized until manually reset, through a manual switch 73, a set of normally closed contacts CR260*b* and now-closed contacts LR1*c* of the latch relay. Thus, after power has been removed from step switch contact 71*d*, the latch relay 71 may be reset by momentary closing of the manual switch 73, to reset the alarm.

In addition to opening the selected discharge valve, the relay CR105 functions through now-closed CR105*b* and CR105*c* to energize solenoid valves 52*a*, 54*a*, to open the trap valves 52, 54 for the first reciprocator, and also to energize the pressure override valve 26. Thus, fluids are now directed to the reciprocator and into the purging system at a desirably higher pressure than the typical operating pressure at the spray devices. In this respect, whereas typical operating pressures for the paint may be in the neighborhood of 5–7 psi, the increased pressure for purging may be in the neighborhood of 15–20 psi or greater, enabling a more rapid fluid flow through the system during the purging and color change cycle. In addition, as is described more fully in the aforementioned Wiggins U.S. Pat. No. 3,348,774, the discharge valves of the spray devices 12 advantageously are closed (by appropriate control means, not shown) throughout most of the color change cycle to prevent unnecessary discharge into the spray booth area. However, it may be appropriate to provide in the color change cycle for a momentary opening of the discharge devices during the solvent purge cycle. At this time, the small residual amount (1–2 cc) of paint in the extreme forward end of each discharge device is sprayed out into the booth, followed immediately by solvent itself, which cleanses the spray nozzles.

After opening of the purge system and energizing the pressure override, timing contacts TS1*c* and TS1*d* close and open in sequence, to energize first the solenoid-operated pilot valve 44*a* for the solvent valve 44 and then the air valve 46. The timing of the switches TS1*c* and TS1*d* is such that an adequate volume of solvent is introduced into the supply conduit 17 to properly clean the system including the fluid regulators 14 and spray discharge devices 12. Thereafter, the solvent valve 44 is closed and air is introduced into the system through opening of the valve 46, to push the solvent on into the system and toward the discharge receptacles.

As will be understood, an air purge is not necessary as a theoretical matter, but is highly desirable, where the supply line 17, leading from the paint mix room to the reciprocator station 10 or 11, is of substantial length. In such cases, savings may be realized by introducing no more solvent than is necessary to effect clean out, and following this up with an air purge to drive the solvent throughout the system in the desired manner.

In the system of the invention, the primary color change cycle for the first reciprocator station 10 continues until adequate amounts of solvent and air have been introduced, after which the selected new paint is introduced, as by closing of contacts TS1*e* associated with a paint color selection circuit (not shown). The incoming new paint purges ahead of it the previously introduced solvent and air.

In the illustrated circuit the relay CR105 is kept energized throughout the cycle by now-closed contacts LR2*a* of a latch relay LR2. The latch relay LR2 is initially energized through normally closed contacts LR2*b*, in series with timing switch TS1*b*. When the new paint has entered, but not fully traversed, the inventory line 53 of the first reciprocator, timing contacts TS1*f* momentarily close to release the latch relay LR2, deenergizing the relay CR105 and closing the trap valves 52, 54 for the reciprocator station 10.

In the illustrated arrangement, with two reciprocator banks arranged in tandem for sequential operation, a further set of timing contacts, TS1*g* closes momentarily at the completion of the primary purge cycle for the first reciprocator, to start a second timing motor TM2 initiating a color change cycle for the second reciprocator bank 11. After momentary closure of TS1*g*, timing switch contact TS2*a* closes, keeping the timing motor TM2 energized throughout a single type of operation.

With the color change cycle for the second reciprocator station now under way, closing of the timing switch TS2*b* has already energized relay CR205, maintaining the discharge valve 58 energized through now-closed contacts CR205*a*. Additional contacts CR205*b* have also now closed to energize pilot solenoids 52*a*, 54*a* and open the trap valves 52, 54 for the second reciprocator bank 11. Contacts CR205*c* also have closed to energize the pressure override valve 26 for the second reciprocator.

As in the first described color change cycle, timing switch contacts TS2*c* and TS2*d* close in sequence to effect operation of the solvent and air valves 44, 46, for the second reciprocator, and bring about a purging of the existing paint therefrom. In due course, contacts TS2*e* close, causing the new paint to be introduced into the system, by the separate color selection control means, not shown. Although, timing switch TS2*b* is now open, relay CR205 remains energized through closed contacts LR3*a* of latch relay LR3, the latter having been initially actuated and latched upon closure of timing switch TS2*b*, through normally closed contacts LR3*b*. CR205 thus remains energized, keeping the second reciprocator trap valves 52, 54 open. However, when new "front" of paint enters the inventory line 53 for the second reciprocator, the timer motor momentarily closes switch TS2*f* to release the latch relay LR3, and thereby deenergize the control relay CR205. This closes the second set of trap valves 52, 54, so that the second reciprocator stage may now be returned to active production.

Referring now to FIG. 3, deenergizing of the control relay CR205, at the conclusion of the primary purge cycle for the second reciprocator, closes a set of contacts CR205*d* and, a moment later, opens a set of normally open, time-delay-open contacts CR205*e*. This momentarily completes an energizing circuit for a third timing motor TM3, initiating a timing cycle of that motor for controlling the secondary purge cycle. A timing switch TS3*a* is closed immediately by the timing motor TM3 and maintains the energizing circuit for the complete cycle. At the same time, a control relay CR260 is energized. Among other things, this opens contacts CR260*a* (FIG. 2) to preclude energization of the first timing motor TM1, so that a color change cycle of the reciprocators 10, 11 cannot be initiated during the secondary purge cycle.

As the timing motor TM3 cycles, a solenoid valve 62*a* is energized, opening the solvent valve 62 for the secondary purge system and admitting solvent into the purge manifold 56 and purge outlet line 55. After an appropriate interval, the contacts TS3*b* are opened and a further set of contacts TS3*e* are closed, energizing a solenoid air valve 64. This admits air into the purge manifold and purge outlet line, to drive out the solvent. It may be noted in this respect that air valves may conveniently be located remotely of the reciprocator area and generally do not have to be air operated.

At the end of the secondary purge cycle, the holding contacts TS3*a* open, deenergizing the timing motor TM3 and the control relay CR260. After a predetermined time delay, calculated to permit the air pressure within the purge outlet line 55 to be reduced to ambient levels, time-delay-off contacts CR260*a* and CR260*b* to open, closing the then-open dump valve 58 and deenergizing step switch solenoid valve 71*e* to shift the step switch 71 to the next dump valve (59) in sequence.

As will be appreciated, the secondary purge operation may be taking place after the reciprocator stations 10, 11 have returned to normal production. Perhaps more importantly, the flow of purged materials during the secondary purge cycle, is limited to the area from the purge manifold 56 to the discharge vessels, and is not required to be circulated out from the paint mix room, through the reciprocator stage and then back to the paint mix room. The advantageous arrangement of this invention, thus enables substantial savings to be realized in both time and materials.

After a series of color change cycles (four in the illustrated arrangement FIG. 3), it is necessary that the collection vessels 58*b*–61*b* be emptied. To be sure that this is carried out and to avoid intermixing paints of different color, a latch relay LR1 is connected through its normally closed contacts LR1*a*, in parallel with the actuating solenoid valve 61*a* for the dump valve 61. Thus, when the step switch contacts 71*d* are closed, and the solenoid valve 61*a* is actuated, the latch relay LR1 is momentarily energized and latched. Contacts LR1*b* are thereupon locked closed. When relay CR260 is later deenergized, at the end of the secondary purge cycle, contacts CR260*b* close, energizing a horn 72 or other alarm. This will remain activated until the operator at the paint mix room momentarily closes a reset switch 73 to release the latch relay.

Figure 4:
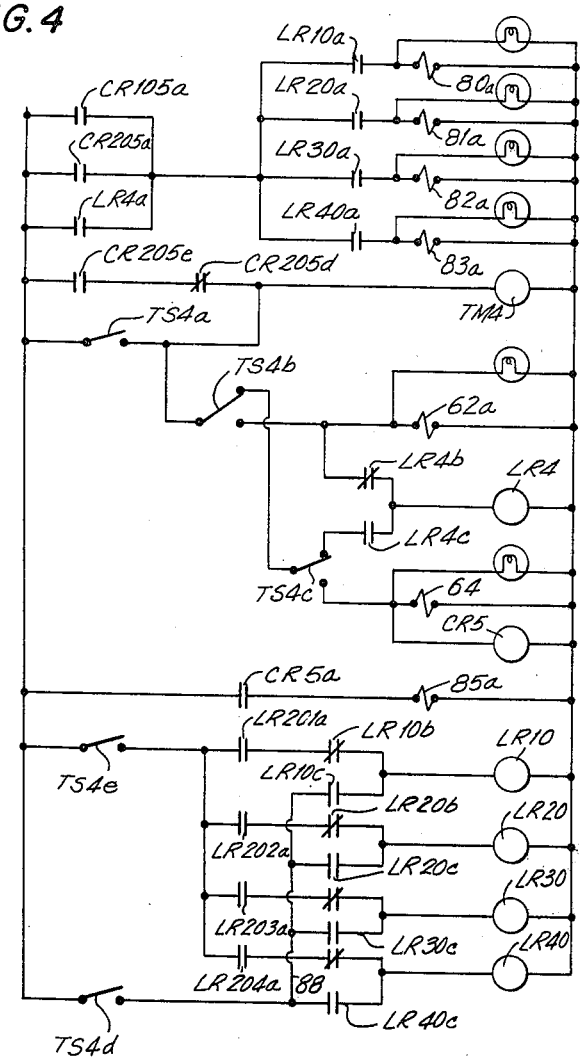
FIGS. 4 and 5 are simplified, schematic representations of a modified form of the invention of FIGS. 1–3, illustrating an arrangement for returning the purged paints selectively to their original supply containers or to individual auxiliary vessels associated therewith.
Figure 5:
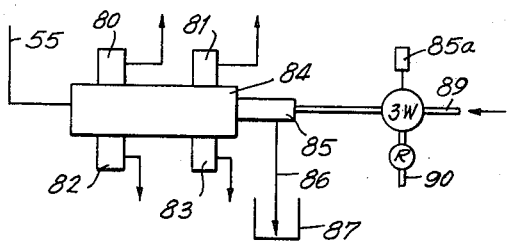

Referring now to FIGS. 4 and 5, there is shown a system according to the invention, which includes somewhat more elaborate circuit arrangements for directing the purged materials back into the individual mixing vessels associated original containers of coating material, or possibly directly back to the supply vessel itself. To this end, the system of FIGS. 4 and 5, has a series of four paint return valves 80, 81, 82, 83, which are mounted on an in-line common cavity manifold block 84. It is contemplated, that there will be as many paint return valves as there are paint selection valves in the system. Thus, although only four valves are shown, for the sake of simplicity, a typical commercial system may utilize a rather large number, depending upon the number of coating materials and colors utilized regularly in production.

As reflected in FIG. 5, the purge discharge line 55 is connected to one end of the common cavity manifold 84, upstream of all of the paint return valves 80–83. In addition, a waste dump valve 85 is connected to the opposite end of the manifold downstream of all of the paint return valves. The waste dump valve discharges through a waste line 86 into a waste discharge vessel 87.

In conjunction with the system of FIGS. 4 and 5, there is conventionally provided a paint selection circuit, (not shown, and forming no part of the present invention), which includes a series of latch relays, one for each color of the selection system. These color selection latch relays are actuatable one at a time and, in the illustrated circuit, will bring about the closing of one of a plurality of sets of latch relay contacts LR201*a*–LR204*a*. The selected contacts will, of course, have been closed at the commencement of the paint cycle, as part of the original color selection operations, and, as will appear hereinafter, will have actuated a selected latch relay LR10–LR40 which remains latched until near the end of the secondary purge cycle.

Assuming that the latch relay LR20 is in the latched condition at the commencement of a primary purge cycle, then the energizing of relay CR105 (FIG. 2) to commence color change for the reciprocator stage 10, will close contacts CR105*a* and energize, through contacts LR20*a*, a solenoid pilot valve 81*a* associated with the paint return valve 81. Thus, at the initiation of color change, the return valve 81 is opened, connecting the purge system with the paint vessel used to supply paint during the just completed painting cycle. The sequence of events involved in the color change cycle for the reciprocator stage 10, is the same as previously described in connection with the system of FIG. 3, bearing in mind that the purged materials in this instance are being returned to a separate pre-mix vessel associated with the original vessel, rather than one of a limited number of separate collection vessels.

Likewise, when the timing motor TM1 times out the primary color change cycle for reciprocator stage 10, it energizes the second timing motor TM2 and commences the primary purge cycle for the second reciprocator stage 11, substantially, as previously described, again bearing in mind that the purged materials are being returned to a pre-mix vessel associated with the original vessel.

At the end of a primary purge cycle for the second reciprocator 11, the relay CR205 is deenergized, and the secondary purge cycle is commenced by energizing of a timing motor TM4. This is accomplished by a series connected set of normally closed time-delay-open contacts CR205*d* and normally open contacts CR205*e*. Once started, the timing motor TM4 is kept energized for one cycle of operation by closing of its own timing switch TS4*a*.

Immediately after commencement of the timing cycle, timing switch TS4*b* is actuated to complete a circuit through solenoid valve 62*a*, controlling the solvent valve 62. Simultaneously, a latch relay LR4 is momentarily actuated, through normally closed contacts LR4*b*, and latched. This closes contacts LR4*a*, maintaining the energizing circuit for the selected solenoid pilot valve 81*a* controlling the paint return valve 81.

After an appropriate period of solvent flush, the timing switch TS4*b* opens the circuit to solenoid valve 62*a* and a timing switch TS4*c* closes the circuit to solenoid valve 64 controlling the purging air. This simultaneously completes the energizing circuit to a control relay CR5. After a predetermined time delay period, time-delay-on contacts CR5*a* close, energizing a solenoid valve 85*a* controlling the waste dump valve 85, and opening the purge system to the waste receptacles 87 through the waste line 86. The timed closing of contacts CR5*a* is such that most of the solvent will have been advanced through the open return valve 81. Upon the subsequent opening of the valve 85, only a small quantity of solvent is discharged to waste, and the purging air is exhausted to atmosphere. In this respect, it is sometimes preferable to avoid directing of the purging air back into the original paint vessel, or associated pre-mix vessel, particularly if the coating material is sensitive to foaming. In such cases, it may even be desirable to eliminate the air purge step from the primary purge cycle or, alternatively, to provide for the timed discharge to atmosphere of air during the primary purge cycle, as well as during the secondary purge cycle. In this respect, an air purge operation generally is required in situations where water-based and solvent-based paints are being used interchangeably in the painting system. The air is desirable, in such cases, to separate the immiscible materials.

Continued cycling of the timing motor TM4 causes a further timing switch TS4*d* to close, energizing a reset circuit connected through conductor 88 to each of the latch relays LR10–LR40 through normally open contacts LR10*c*–LR40*c*. At this time, whichever latch relay is in the latched condition, will be released in preparation for selection of a new color of paint to be introduced in the next subsequent color change cycle.

Immediately prior to the closing of timing switch TS4*d*, the timing switch TS4*c* is actuated to open the circuit to solenoid valve 64 and control relay CR5. Switch TS4*c* at this time also completes a circuit to the latch relay LR4, releasing that relay from its latched condition and thus opening contacts LR4*a* and deenergizing the selected solenoid valve 81*a* to close the paint return valve 81. With relay CR5 now deenergized, solenoid valve 85*a* is deenergized. To advantage, this valve is a three-way valve connecting the waste dump valve 85 to a source of actuating air 89, when energized, and through a restriction R to a discharge line 90, when deenergized. The restriction R delays the closing of the waste dump valve 85, to be certain that the purge outlet line 55 is at ambient pressure before the valve closes.

At some point, usually prior to commencement of the color change cycle, and in any event prior to termination of a color change cycle, a new paint color is selected by means of a color selector system (not shown). Upon this occasion, a selected set of latch relay contacts will have been closed. In the example, the just purged paint corresponded to latch relay LR20, which had been energized at the end of the previous cycle by closing of latch relay contacts 202*a* from the color selection system. At this stage of the cycle, a new color having been selected, a new set of contacts (e.g. LR204*a*) will have been closed. Thus, at the end of the secondary purge cycle approaches, timing contacts TS4*e* are momentarily closed, energizing a selected latch relay, in this illustrated case, LR40. This relay remains in the latched condition until completion of the purge cycle, during which the just-selected color s directed properly to the appropriate supply vessel.

At the end of the cycle, contacts TS4*a* are again opened, deenergizing the timing motor TM4. The purged system thereafter remains inactive after commencement of a subsequent color change cycle and purge cycle.

The new color change system is particularly advantageous for use in installations utilizing a separate paint mix room or area which is located remote from the reciprocator stations. By providing for primary and secondary purging cycles, it is possible to complete the necessary color change operations for a reciprocator stage during a primary cycle and permit it to be returned to production while a secondary purge cycle is being carried out, to complete the full color change cycle. In this respect, the secondary purge cycle may, in accordance with the invention, be confined to that portion of the system downstream of the reciprocator station, leading back to the paint mix room, providing for savings in both reciprocator time and the use of cleaning materials.

A further significant advantage of the new color change system resides in the fact that a color change cycle may be carried out successively for a plurality of reciprocator stations, by performing a series of primary purging cycles, with a single secondary purging cycle being performed after completion of the primary cycle for the last reciprocator station. Thus, in a typical commercial spray painting line, in which parts of large sizes are conveyed through the spray area, presenting a variety of surfaces to be coated, it is frequently necessary to provide a succession of reciprocator stations, with successive stations coating different surfaces of the workpieces, which are indexed to a new orientation while traveling from one reciprocator to another. In such cases, when a color change is to be effected on the production line, it is carried out for all of the reciprocator stations. In the system of the invention, the primary purging cycle for the second reciprocator also serves to displace the clean out materials from the first reciprocator back to the desired collection vessel in the paint mix room and so on. After the primary purge cycle for the last reciprocator, a single secondary purge cycle cleans out the return line downstream of the reciprocators so that, at the time of the next subsequent color change, there will be no undesirable contamination of one color by another.

In a simplified form of the system of the invention, the purged materials from successive color change cycles are directed sequentially into a limited number of collection vessels, on an effectively segregated basis, so that the purged materials may be returned and mixed with the original paints for re-use. After all of the collection vessels have been utilized an alarm is sounded, to be certain that the operator at the paint mix room attends to emptying and replacement of the collection vessels.

In a somewhat more elaborate system, the purge system, downstream of the reciprocators, has a multiple outlet, common cavity manifold, with separately controllable valves for each color of coating material furnished in the color selection system. When a designated color of paint is originally selected, to be introduced into a color change cycle, the system also selects a corresponding discharge valve of the purge manifold. Subsequently, when that designated color is purged from the system, it is purged through the selected discharge valve and returned, either directly to the original paint supply container or (more likely) to a separate, associated pre-mix vessel. In this form of the invention, the purge manifold includes, in addition to the individual color discharge valves, a waste discharge valve located downstream of the paint discharge valves and which is selectively opened shortly before the end of the secondary purge cycle, permitting a quantity of solvent, as well as residual air to be discharged to waste. This assures that the purge manifold is properly cleaned for the next cycle, and also prevents or minimizes the discharge of air back to the original supply vessel.

An important feature of the invention resides in the provision of trap valve means, located downstream of the reciprocator stage and straddling an elongated inventory line. This feature permits reliable segregation of one paint color from another during color change cycles, so that the flushed-out materials may be collected and saved for re-use. While in the illustrated examples given herein, the system of the invention has been utilized in conjunction with a paint mix room or area located remotely from the reciprocators, such a feature is not necessarily required in conjunction with this last-stated feature of the invention. Even in a highly simplified system, where the paint supply and return vessels are located immediately adjacent to the reciprocator apparatus, the provision of the inventory line straddled by trap valves serves to provide the desired, reliable segregation of materials.

Typically, the actuation of the trap valves 52, 54 will be effected under the control of a timing mechanism. However, in certain simplified installations, it may be desirable to operate the trap valve manually. In such cases, the inventory line will be formed of a transparent or translucent tubing. The machine operator, standing by the machine during a color change cycle, is able to observe the entry into the transparent or translucent inventory line of the frontier of new color paint. As soon as the new paint is downstream of the first trap valve, the operator may manually close the two valves, such that the new frontier of new paint is trapped between them. In this respect, even in the automatic or timed system, it may be desirable to form the inventory line of transparent or translucent material to aid in initial setting of the timing switches and to enable the automatic operation of the equipment to be monitored by the operator.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A color change system for a paint spray installation, which comprises a. a paint spray station, b. a paint supply area located remote from said spray station and including first supply means for supplying paints and cleaning materials for the spray station, c. supply conduit means for delivering said paints and cleaning materials to said spray station, d. purge discharge conduit means communicating with said spray station for conveying paints and cleaning materials away from said spray station, and e. second supply means connected to said purge discharge conduit for introducing cleaning materials into said purge discharge conduit immediately adjacent said spray station.

2. A color change system according to claim 1, further characterized by a. said purge discharge conduit extending from said spray station back to said paint supply area, b. said second supply means being connected to said purge discharge conduit on the downstream side of said spray station.

3. A color change system according to claim 2, further characterized by a. at least one trap valve in said purge discharge line located in the general vicinity of said spray station upstream of said second supply means.

4. A color change system according to claim 3, further characterized by a. a second trap valve in said purge discharge line upstream of said second supply means, and b. a conduit of substantial length interconnecting said trap valve and forming part of said discharge system.

5. A color change system according to claim 4, further characterized by a. the conduit connecting said tray valve being formed of transparent or translucent material.

6. A color change system according to claim 2, further characterized by a. said system comprising a plurality of paint spray stations, b. said supply conduit means comprising a common conduit for delivering said paints and cleaning material to said plurality of paint spray stations, c. a common purge discharge conduit communicating with said plurality of spray stations for conveying paints and cleaning materials away from said stations, d. color change cycling means operative to effect primary purge and color change operations with respect to each of said plurality of paint spray stations, and e. purge cycling means operative after said primary purge and color change operations to initiate a secondary purge cycle, in which cleaning materials are introduced from said second supply means into said purge discharge conduit.

7. A color change system for a paint spray installation, which comprises a. a paint spray station, b. supply conduit means for delivering paints and cleaning materials to said spray station, c. purge discharge conduit means for conveying paints and cleaning materials away from said station, and d. purge manifold means connected to said purge discharge conduit means and including a plurality of selectively operable discharge valves for controllably directing the discharge of purged materials into selected reception vessels, to effect segregated collection of purged coating materials, e. said discharge conduit means including a pair of trap valves, and a section of inventory conduit, interconnecting said tray valves and forming part of said discharge conduit means, f. whereby said trap valves may be closed to isolate the advancing front of a new color of paint during the course of a color change cycle.

8. A color change system according to claim 7, further characterized by a. purge valve means located downstream of said section of inventory conduit, for introducing cleaning fluids into said purge discharge conduit, when said trap valves are closed.

9. A color change system for a paint spray installation, which comprises a. a plurality of paint spray stations, b. a paint mix area located remotely of said paint spray station and including means for delivering selected paints and for receiving discharge paints and cleaning fluids, c. a common supply line leading from said paint mix area and serving said plurality of paint spray stations, d. a common purge line for returning paints and cleaning fluids to said paint mix area, and serving said plurality of paint spray stations, e. a plurality of individual discharge lines interconnecting the individual spray stations to said common discharge line, said individual discharge lines including a pair of trap valves straddling a section of line of substantial length for isolating a front of new coating material following a color change cycle in a spray station.

10. A color change system according to claim 9, further characterized by a. the sections of line extending between said isolation valves being formed of transparent or translucent material.

11. A color change system for a paint spray installation, which comprises a. separate supply and discharge lines communicating with the paint spray installation, b. color change valve means connected to the supply line for controllably introducing thereinto paint of original color, cleaning fluids, and paint of a new color, c. A pair of trap valves located in said discharge line and connected together by a predetermined section of said discharge line, and d. means for closing said trap valves in response to a determination that paint of a new color has entered said predetermined section.

12. A color change system according to claim 11, further characterized by a. said predetermined section being formed of transparent or translucent material.

13. A color change system according to claim 11, further characterized by a. timing means being provided for effecting timed closing of said trap valves.

* * * * *